US007573399B2

(12) United States Patent
Schwartz

(10) Patent No.: US 7,573,399 B2
(45) Date of Patent: Aug. 11, 2009

(54) MULTIMODE TRAFFIC PRIORITY/PREEMPTION VEHICLE ARRANGEMENT

(75) Inventor: Mark A. Schwartz, River Falls, WI (US)

(73) Assignee: Global Traffic Technologies, LLC, Oakdale, MN (US)

( * ) Notice: Subject to any disclaimer, the term of this patent is extended or adjusted under 35 U.S.C. 154(b) by 12 days.

(21) Appl. No.: 11/142,021

(22) Filed: Jun. 1, 2005

(65) Prior Publication Data

US 2006/0273926 A1 Dec. 7, 2006

(51) Int. Cl.
*G08G 1/07* (2006.01)

(52) U.S. Cl. ..... 340/906; 340/907; 340/917

(58) Field of Classification Search ..... 340/906, 340/907, 911, 436, 908, 909, 910, 924, 902, 340/941, 992, 993, 426.2, 426.18, 426.21; 701/202, 208, 201, 213, 217
See application file for complete search history.

(56) References Cited

U.S. PATENT DOCUMENTS

| | | | |
|---|---|---|---|
| 3,550,078 | A | 12/1970 | Long |
| 3,831,039 | A | 8/1974 | Henschel |
| 4,162,447 | A | 7/1979 | Teshirogi et al. |
| 4,162,477 | A | 7/1979 | Munkberg |
| 4,228,419 | A | 10/1980 | Anderson |
| 4,230,992 | A | 10/1980 | Munkberg |
| 4,234,967 | A | 11/1980 | Henschel |
| 4,463,339 | A | 7/1984 | Frick et al. |
| 4,680,811 | A | 7/1987 | Harper et al. |
| 4,704,610 | A | 11/1987 | Smith et al. |
| 4,717,913 | A | 1/1988 | Elger |
| 4,727,600 | A | 2/1988 | Avakian |
| 4,734,881 | A | 3/1988 | Klein et al. |
| 4,914,434 | A | 4/1990 | Morgan et al. |
| 4,970,439 | A | 11/1990 | Stopa |
| 4,972,185 | A | 11/1990 | Stopa et al. |

(Continued)

FOREIGN PATENT DOCUMENTS

WO WO-2006/130634 12/2006

(Continued)

OTHER PUBLICATIONS

"Strobecom II, Optical Preemption and Priority Control System", http://www.tomar.com/strobecom/index.htm, 3, pages. Printed from Internet Feb. 8, 2005.

(Continued)

*Primary Examiner*—Anh V La
(74) *Attorney, Agent, or Firm*—Schwegman, Lundberg & Woessner, P.A.

(57) ABSTRACT

An arrangement for requesting preemption from a vehicle is used in a traffic control system. The arrangement for requesting preemption includes a protocol circuit, a signal control generation circuit, and an optical source. The protocol circuit is adapted to provide a plurality of communication protocols, wherein a plurality of the communication protocols communicate encoded data. The signal control generation circuit is adapted to generate an output signal in accordance with at least one of the plurality of communication protocols. The optical source is adapted to transmit light pulses from the vehicle, wherein the light pulses are generated from the output signal and include the encoded data for said at least one of the plurality of communication protocols.

20 Claims, 3 Drawing Sheets

U.S. PATENT DOCUMENTS

| | | | | |
|---|---|---|---|---|
| 4,992,790 | A | 2/1991 | Montgomery | |
| 5,014,052 | A | 5/1991 | Obeck | |
| 5,159,480 | A | 10/1992 | Gordon et al. | |
| 5,172,113 | A | 12/1992 | Hamer | |
| 5,187,373 | A | 2/1993 | Gregori | |
| 5,187,476 | A | 2/1993 | Hamer | |
| 5,202,683 | A | 4/1993 | Hamer et al. | |
| 5,519,389 | A | 5/1996 | DeGunther et al. | |
| 5,539,398 | A | 7/1996 | Hall et al. | |
| 5,602,739 | A | 2/1997 | Haagenstad et al. | |
| 5,811,886 | A * | 9/1998 | Majmudar | 307/10.2 |
| 5,926,113 | A | 7/1999 | Jones et al. | |
| 5,986,575 | A | 11/1999 | Jones et al. | |
| 6,243,026 | B1 | 6/2001 | Jones et al. | |
| 6,281,808 | B1 * | 8/2001 | Glier et al. | 340/933 |
| 6,429,812 | B1 * | 8/2002 | Hoffberg | 342/357.1 |
| 6,621,420 | B1 * | 9/2003 | Poursartip | 340/907 |
| 7,116,245 | B1 * | 10/2006 | Bachelder | 340/906 |
| 7,417,560 | B2 | 8/2008 | Schwartz | |

FOREIGN PATENT DOCUMENTS

| | | | |
|---|---|---|---|
| WO | WO-2006130357 | A2 | 12/2006 |
| WO | WO-2006130357 | A3 | 12/2006 |
| WO | WO-2006130634 | A2 | 12/2006 |

OTHER PUBLICATIONS

Tomar Electronics, "Strobecom II", System Manual (Rev 3), Jun. 2000, 25 pages. Jun. 2000.

Tomar Electronics, "Strobecom II. Optical Signal Processor Configuration Software (OSPsoft)," User's Manual, Version 2.0 for use with OSP Version 2.0, May 2000, 40 pages. May 2000.

"Elock™ Emitter Authenticator," http://www.tomar.com/products/elock/elock.htm, 11 pages. Printed from Internet Apr. 27, 2005.

"U.S. Appl. No. 11/142,026, Non-Final Office Action mailed Mar. 22, 2007", 8 pgs.

"U.S. Appl. No. 11/142,026, Response filed Sep. 24, 2007 Non-Final Office Action mailed Mar. 22, 2007", 7 pgs.

"International Search Report for PCT/US2006/19379 mailed Jul. 26, 2007", 3 pgs.

"Written Opinion for PCT/US2006/19379 mailed Jul. 26, 2007", 6 pgs.

"U.S. Appl. No. 11/142,026, Notice of Allowance mailed Dec. 13, 2007", 10 pgs.

"U.S. Appl. No. 11/142,026 Notice of Allowance mailed Apr. 18, 2008", 9 pgs.

International Application Serial No. PCT/US2006/21014, Search Report & Written Opinion mailed Aug. 26, 2008, 9 pgs.

* cited by examiner

MULTIMODE TRAFFIC PRIORITY/PREEMPTION VEHICLE ARRANGEMENT

FIELD OF THE INVENTION

The present invention is generally directed to systems and methods that allow traffic light systems to be remotely controlled using data communication, for example, involving optical pulse transmission from an optical emitter to an optical detector that is communicatively-coupled to a traffic light controller at an intersection.

BACKGROUND OF THE INVENTION

Traffic signals have long been used to regulate the flow of traffic at intersections. Generally, traffic signals have relied on timers or vehicle sensors to determine when to change the phase of traffic signal lights, thereby signaling alternating directions of traffic to stop, and others to proceed.

Emergency vehicles, such as police cars, fire trucks and ambulances, are generally permitted to cross an intersection against a traffic signal. Emergency vehicles have typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

There are presently a number of optical traffic priority systems that permit emergency vehicles to preempt the normal operation of the traffic signals at an intersection in the path of the vehicle to permit expedited passage of the vehicle through the intersection. These optical traffic priority systems permit a code to be embedded into an optical communication to identify each vehicle and provide security. Such a code can be compared to a list of authorized codes at the intersection to restrict access by unauthorized users. However, the various optical traffic priority systems are incompatible because the vehicle identification code for each of the various optical traffic priority systems is embedded in the optical communication using incompatible modulation schemes.

Generally, an optical traffic priority system using a particular modulation scheme is independently purchased and implemented in each jurisdiction, such as a city. Thus, the traffic lights and the emergency vehicles for the jurisdiction are equipped to use the particular modulation scheme. However, a neighboring jurisdiction may use equipment that embeds the vehicle identification code using an incompatible modulation scheme. Frequently, a pursuit by a police car or the route of an ambulance may cross several jurisdictions each using an incompatible modulation scheme to embed the vehicle identification information. It may be burdensome and expensive to allow a vehicle to preempt traffic lights in multiple jurisdictions while maintaining appropriate security to prevent unauthorized preemption of traffic lights.

SUMMARY OF THE INVENTION

The present invention is directed to overcoming the abovementioned challenges and others that are related to the types of approaches and implementations discussed above and in other applications. The present invention is exemplified in a number of implementations and applications, some of which are summarized below.

In connection with one embodiment, the present invention is directed to implementations that allow traffic light systems to be remotely controlled using multiple communication protocols.

According to a more particular embodiment, an arrangement for requesting preemption from a vehicle is used in a traffic control system. The arrangement for requesting preemption includes a protocol circuit, a signal control generation circuit, and an optical source. The protocol circuit is adapted to provide a plurality of communication protocols, wherein a plurality of the communication protocols communicate encoded data. The signal control generation circuit is adapted to generate an output signal in accordance with at least one of the plurality of communication protocols. The optical source is adapted to transmit light pulses from the vehicle, wherein the light pulses are generated from the output signal and include the encoded data for the at least one of the plurality of communication protocols.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the detailed description of various embodiments of the invention in connection with the accompanying drawings, in which.

Figure 1:
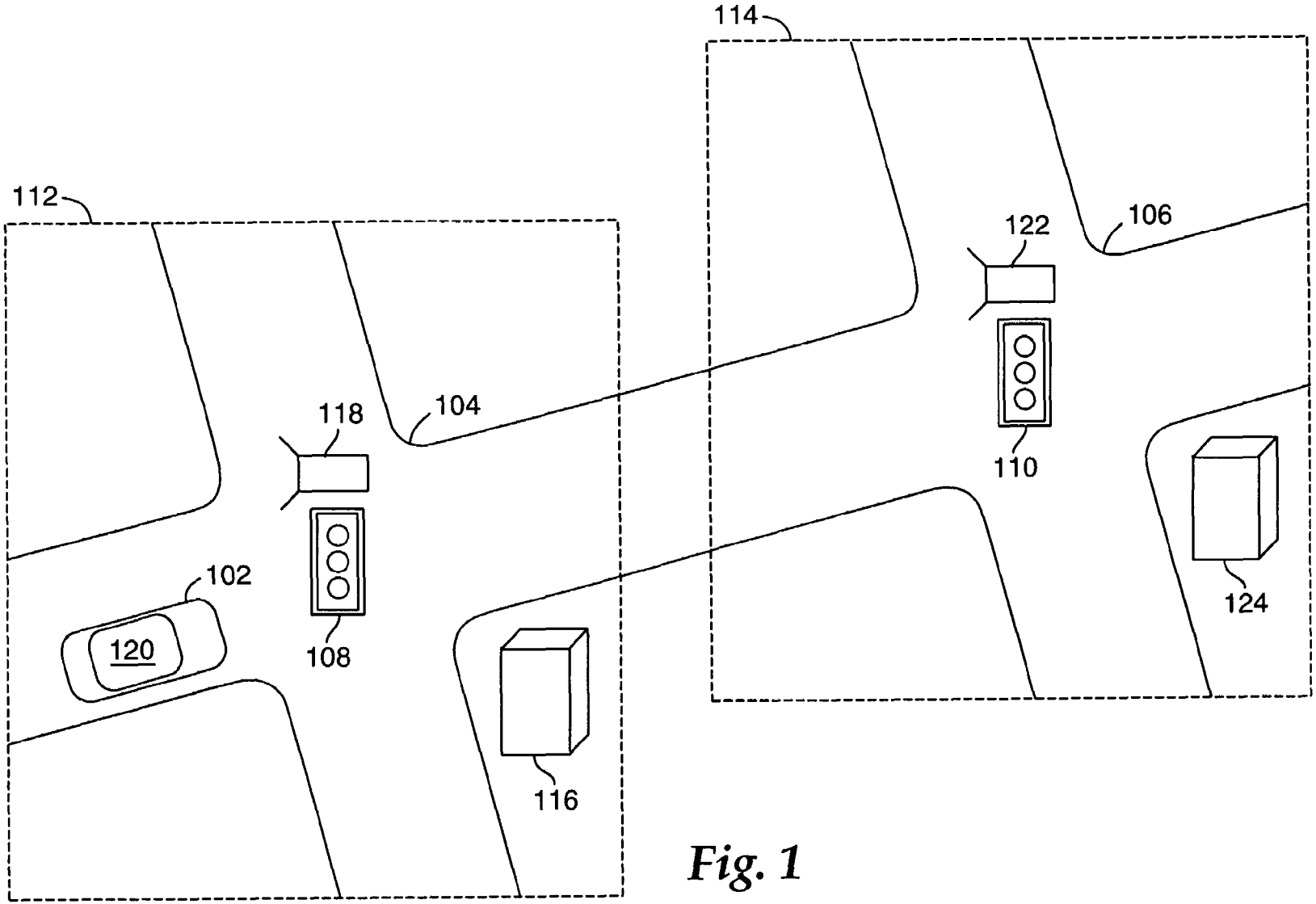
FIG. 1 is a view of a vehicle approaching and controlling multiple traffic intersections using incompatible communication protocols for preemption of the traffic lights in accordance with the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION OF THE EMBODIMENTS

The present invention is believed to be applicable to a variety of different communication protocols in an optical traffic preemption system. While the present invention is not necessarily limited to such approaches, various aspects of the invention may be appreciated through a discussion of various examples using these and other contexts.

FIG. 1 is a view of a vehicle 102 approaching and controlling multiple traffic intersections 104 and 106 using incompatible communication protocols for preemption of the traffic lights 108 and 110 in accordance with the present invention. Intersection 104 is in jurisdiction 112, such as a city, and intersection 106 is in jurisdiction 114. A governmental body for jurisdiction 112, such as a city government, can install a traffic light control system for traffic light 108 permitting preemption of the normal operation of the traffic light 108 to expedite passage through the intersection 104 by an emergency vehicle 102. A separate governmental body for jurisdiction 114 can similarly install a traffic light control system for traffic light 110.

Intersection 104 has a traffic light controller 116 that controls the operation of traffic lights 108 and supports preemption of the normal operation of the traffic lights 108. Typically, the traffic light control system for intersection 104 includes one or more detectors 118 that detect stroboscopic optical light pulses from an emitter 120 of vehicle 102. Typically, an optical source of the emitter 120 is mounted on the roof of the vehicle 102 orientated to emit the optical light pulses in the direction of travel by the vehicle 102. Signals from the detector 118 for a requested preemption of the traffic light 108 by vehicle 102 are coupled to the traffic light controller 116. In response to the requested preemption, the traffic light controller 116 adjusts the phase of the traffic lights 108 to permit passage of the vehicle 102 through the intersection 104. Intersection 106 may similarly have detectors 122 and controller 124 for traffic light 110.

Jurisdictions 112 and 114 can install traffic light control systems for intersections 104 and 106 that are incompatible. The communication protocol used to communicate a preemption request to traffic light controller 116 via detector 118 can be incompatible with the communication protocol used to communicate a preemption request to traffic light controller 124 via detector 122. Typically, a vehicle 102 is associated with a jurisdiction, for example, vehicle 102 can be associated with jurisdiction 112. Jurisdiction 112 can equip vehicle 102 with an emitter 120 that is compatible with each traffic light 108 in jurisdiction 112; however, emitter 120 could be incompatible with the traffic lights 110 in jurisdiction 114.

Frequently, an ambulance transporting a patient or a fire truck responding to a fire alarm crosses multiple jurisdictions 112 and 114. A duplicate of emitter 120 can be installed in vehicle 102 for vehicle 102 to be able to request preemption of both traffic lights 108 in jurisdiction 112 and traffic lights 110 in jurisdiction 114. The incompatibility between certain traffic light control systems is limited to encoded data embedded in the stroboscopic optical pulses, such as the data value of a vehicle identification code used to authorize and log each preemption request. A jurisdiction 114 can configure traffic light controller 124 to omit authorization and logging of a preemption request from an emitter 120 using an incompatible protocol to embed data values in the stroboscopic optical pulses. However, omission of authorization and logging to enable preemption of traffic lights 110 by vehicles 102 from another jurisdiction 112 makes traffic lights 110 in jurisdiction 114 vulnerable to preemption by unauthorized users and limits the capability to detect preemption by unauthorized users.

Various embodiments of the invention provide for preemption of traffic lights 108 and 110 having corresponding communication protocols that are incompatible without duplicating equipment and without sacrificing the authorization and logging of vehicle identification codes.

According to a specific example embodiment, the emitter 120 of FIG. 1 is implemented using a known implementation that is modified to support multiple communication protocols. For example, an Opticom™ Priority Control System (manufactured by 3M Company of Saint Paul, Minn.) can be modified to support one or more communication protocols in addition to the communication protocol for the Opticom™ Priority Control System. Consistent with features of the Opticom™ Priority Control System, one or more embodiments of U.S. Pat. No. 5,172,113 can be modified in this manner. Also according to the present invention, another specific example embodiment is implemented using another commercially-available traffic preemption system, such as the Strobecom II system (manufactured by TOMAR Electronics, Inc. of Phoenix, Ariz.), modified to support one or more additional communication protocols.

Figure 2A:
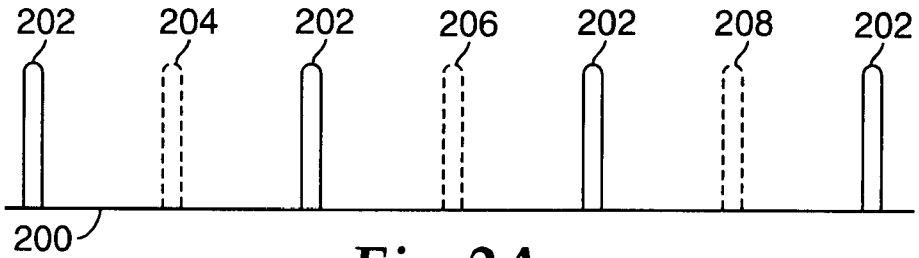
FIGS. 2A, 2B and 2C illustrate optical pulses transmitted between a vehicle and equipment at an intersection for various example communication protocols in accordance with the present invention.
Figure 2B:
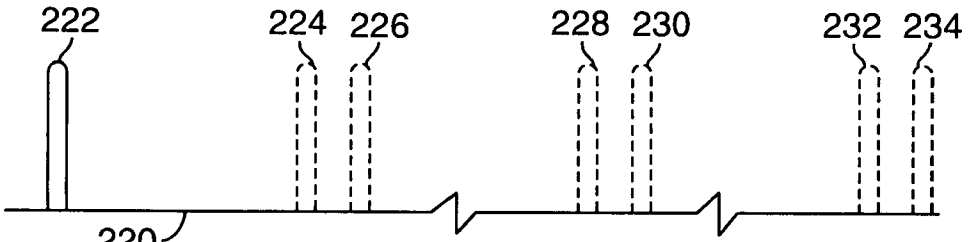
Figure 2C:
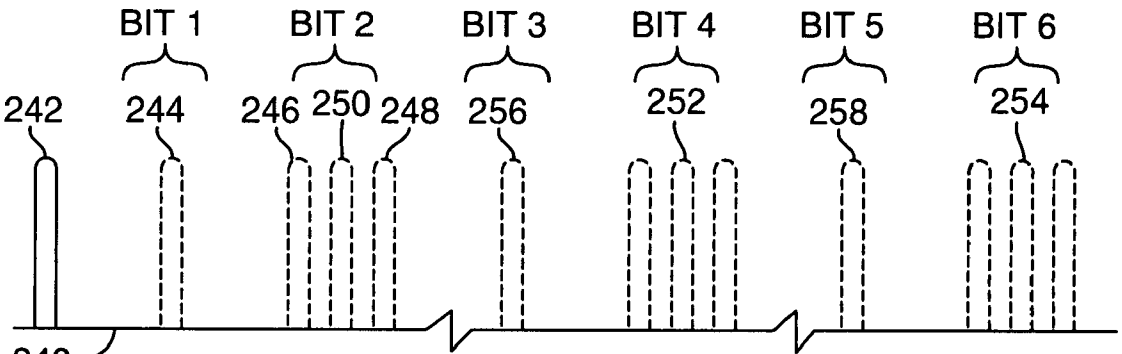

FIG. 2 illustrates optical pulses transmitted between a vehicle and equipment at an intersection for various example communication protocols in accordance with the present invention. A first communication protocol can have optical pulse stream 200 and a second communication protocol can have optical pulse stream 220. A third communication protocol can have optical pulse stream 240 that combines the features of optical pulse streams 200 and 220.

Optical pulse stream 200 has major stroboscopic pulses of light 202 occurring at a particular frequency that typically is nominally either 10 Hz or 14 Hz. Between the major pulses, optional data pulses 204, 206, and 208 embed the encoded data values in the optical pulse stream 200. For example, if pulse 204 is present then an encoded data value has a first bit of one, and if pulse 204 is absent then the encoded data value has a first bit of zero. If pulse 206 is present then the encoded data value has a second bit of one, and if pulse 206 is absent then the encoded data value has a second bit of zero. Similarly, if pulse 208 is present then the encoded data value has a third bit of one, and if pulse 208 is absent then the encoded data value has a third bit of zero. Typically, the optional pulses 204, 206, and 208 are half-way between the major pulses 202. Optical pulse stream 200 may correspond to the communication protocol of an Opticom™ Priority Control System.

Optical pulse stream 220 has stroboscopic pulses of light that nominally occur at a particular frequency that typically is approximately either 10 Hz or 14 Hz, but the pulses are displaced from the nominal frequency to embed the encoded data values in the optical pulse stream 220. For example, after an initial pulse 222, only one or the other of pulses 224 and 226 is present and if an early pulse 224 is present then an encoded data value has a first bit of zero and if late pulse 226 is present then the encoded data value has a first bit of one. Only one or the other of pulses 228 and 230 is present and if early pulse 228 is present then the encoded data value has a second bit of zero and if late pulse 230 is present then the encoded data value has a second bit of one. Similarly, only one or the other of pulses 232 and 234 is present and if early pulse 232 is present then the encoded data value has a third bit of zero and if late pulse 234 is present then the encoded data value has a third bit of one.

Typically, each pulse 224 through 234 is separated from the prior pulse with a nominal time period corresponding to the nominal frequency with the actual separation between a pulse and the prior pulse being slightly less or slightly more than the nominal time period. An early pulse with a separation from the prior pulse of slightly less than the nominal time period embeds a data bit of zero and a late pulse with a separation from the prior pulse of slightly more than the nominal time period embeds a data bit of one. For example, if pulse 224 is present then a second bit of zero is embedded when pulse 228 is separated from pulse 224 by slightly less than the nominal time period, and if pulse 226 is present then a second bit of zero is embedded when pulse 228 is separated from pulse 226 by slightly less than the nominal time period. Such an optical pulse stream may correspond to the communication protocol of a Strobecom II system.

Optical pulse stream 240 combines pulse positions of optical pulse streams 200 and 220, allowing more encoded data or duplicated encoded data to be transmitted within a given time interval. After an emitter transmits an initial pulse 242, the presence or absence of pulse 244 respectively provides a first bit of one or zero, and the presence of either pulse 246 or pulse 248 respectively provides a second bit of zero or one. The additional bits three through six are similarly embedded by pulses 250 through 260.

In one embodiment, pulses 244, 250, and 252 are transmitted by a multiple-protocol emitter one-half of the nominal period after the previous pulse. For example, if pulse 246 is present then pulse 250 is transmitted one-half of the nominal period after pulse 246 and if pulse 248 is present then pulse 250 is transmitted one-half of the nominal period after pulse 248. In another embodiment, pulses 244, 250, and 252 are transmitted half-way between the previous and following pulses.

A traffic light control system can have emitters on vehicles with one timing generator, such as a crystal oscillator, and controllers at intersection with another timing generator. To account for the possible timing differences between the timing generators at the emitter and controller, a controller designed to receive optical pulse stream 200 can have a tolerance for the nominal frequency for pulses 202. Thus, a controller designed to receive optical pulse stream 200 can accept a range of frequencies for pulses 202 that encompasses the nominal frequency for pulses 202.

An emitter can transmit optical pulse stream 240 with the frequencies for mutually exclusive pulses 246 and 248 within the tolerance range of frequencies for pulses 202. When an emitter transmits an optical pulse stream 240 to a controller designed to receive optical pulse stream 200, this controller can recognize either pulse 246 or pulse 248, regardless of which of pulses 246 and 248 is actually transmitted, as a corresponding pulse 202. Thus, existing and future controllers designed to receive optical pulse stream 200 may ignore the frequency shifting of pulses 246 and 248. An emitter transmitting optical pulse stream 240 is compatible with a controller designed to receive optical pulse stream 200 when pulses 244, 250, and 252 are present or absent in a manner corresponding to pulses 204, 206, and 208, respectively.

Generally, pulses 244, 250, and 252 are ignored by a controller designed to receive optical pulse stream 220. An emitter transmitting optical pulse stream 240 is compatible with existing and future controllers designed to receive optical pulse stream 220 when pulses 246 or 248, 254 or 256, and 258 and 260, are positioned to correspond to pulses 224 or 226, 228 or 230, and 232 or 234, respectively.

An emitter that transmits optical pulse stream 240 has the advantages of supporting a higher data communication rate and/or being compatible with either or both of optical pulse streams 200 and 220. In one embodiment, the data values transmitted for bits one, three, and five are always zero corresponding to the absence of pulses 244, 250, and 252, to produce an optical pulse stream 240 that is compatible with optical pulse stream 220. In another embodiment, the data values transmitted for bits two, four, and six are all always zero or all always one, corresponding to a constant frequency shift, to produce an optical pulse stream 240 that is compatible with optical pulse stream 200. It will be appreciated that elimination of the frequency shifting can improve compatibility. In these two embodiments, an emitter transmitting optical pulse stream 240 is compatible with one or the other, but not both, of a controller designed to receive optical pulse stream 200 and a controller designed to receive optical pulse stream 220. When an emitter is configurable to implement either of these two embodiments, only one type of emitter needs to be designed, to have inventory stocked, and to be supported.

An emitter transmitting optical pulse stream 240 can concurrently activate preemption of two traffic lights having controllers designed to receive optical pulse stream 200 for one traffic light and optical pulse stream 220 for the other traffic light. For example, two adjacent traffic lights a block apart can be situated within different jurisdictions that have installed controllers designed to receive optical pulse stream 200 for one traffic light and optical pulse stream 220 for the other traffic light. An emergency vehicle approaching both traffic lights can concurrently activate preemption at both traffic lights when the emergency vehicle is equipped with an emitter transmitting optical pulse stream 240.

In one embodiment, each jurisdiction manages the assignment of a vehicle identification code to each vehicle authorized to activate preemption of traffic lights within the jurisdiction. A vehicle can be assigned two vehicle identification codes, with one vehicle identification code assigned by a first jurisdiction with traffic lights controllers designed to receive optical pulse stream 200 and another vehicle identification code assigned by a second jurisdiction with traffic light controllers designed to receive optical pulse stream 220. An emitter for the vehicle may transmit a preemption request with one vehicle identification code embedded as encoded data in pulses such as pulses 244, 250, and 252, and the other vehicle identification code embedded as encoded data in pulses such as pulses 246 and 248, 254 and 256, and 258 and 260. The optical pulse stream 240 with the two embedded vehicle identification codes can concurrently activate preemption in both jurisdictions.

In another embodiment, vehicle identification codes are cooperatively assigned by the jurisdictions, possibly with each emergency vehicle being assigned a single vehicle identification code. An emitter for a vehicle may transmit a preemption request with the vehicle identification code embedded as encoded data in pulses, such as pulses 244, 250, and 252, and the same vehicle identification code embedded as encoded data in pulses, such as pulses 246 and 248, 254 and 256, and 258 and 260. The optical pulse stream 240 with the duplicated embedding of the vehicle identification code can concurrently activate preemption in both jurisdictions.

In yet another embodiment, pulses 244 through 260 can embed a single preemption request that can transfer more encoded data bits between an emitter and a controller in a given period of time. An emitter can be configurable to enable transmission of an optical pulse stream 240 that is only compatible with controllers designed to receive optical pulse stream 200, only compatible with controllers designed to receive optical pulse stream 220, concurrently compatible with controllers designed to receive either optical pulse stream 200 or 220, and/or compatible with controllers designed to receive optical pulse stream 240 at a higher data transfer rate than optical pulse streams 200 and 220. The additional encoded data can be used to provide additional operations, to enhance the security using encryption employing an encryption key, and/or enhance robustness by adding error detection or correction without increasing the response time of the optical traffic control system.

The nominal frequency used to transmit pulses of an optical pulse stream 200, 220, and 240 can determine a priority. For example, a frequency of approximately 10 Hz can correspond to a high priority for an emergency vehicle and a frequency of approximately 14 Hz can correspond to a low priority for a mass transit vehicle.

Figure 3:
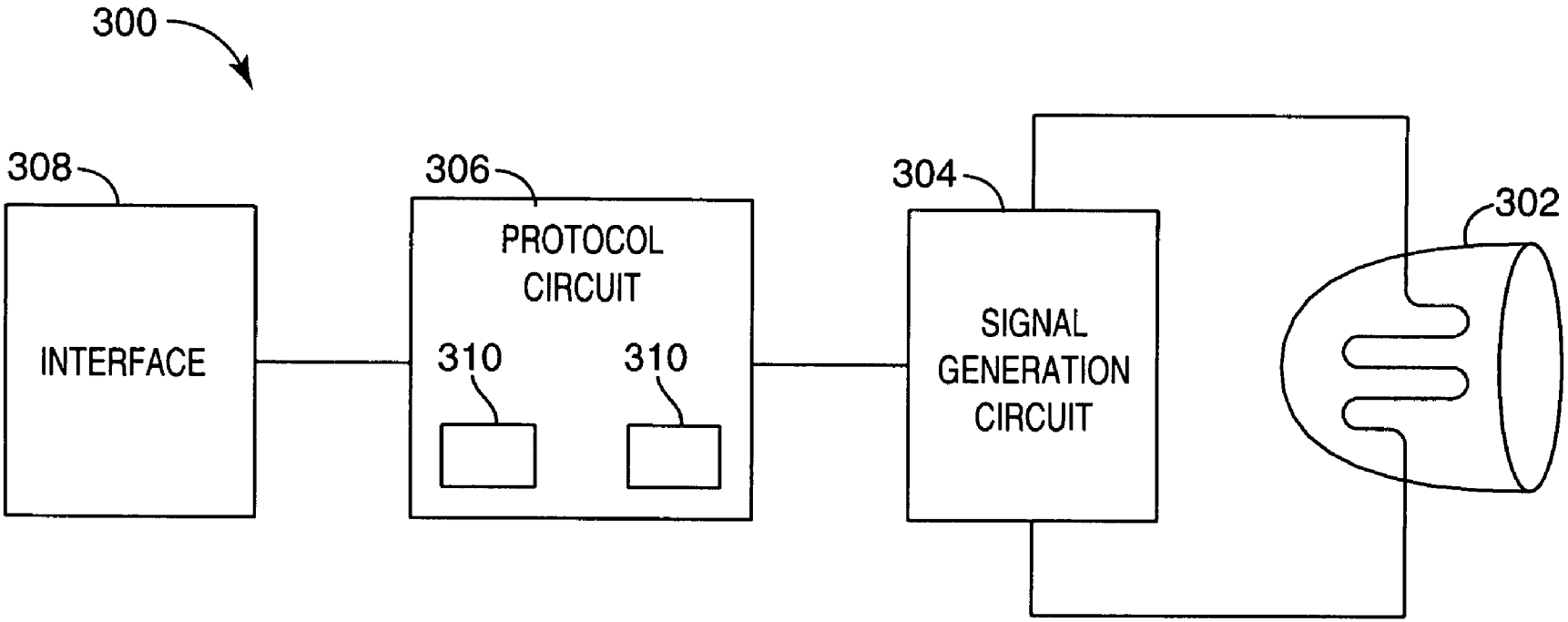
FIG. 3 is a block diagram of the components of an emitter for optical traffic preemption system for an embodiment in accordance with the present invention.

FIG. 3 is a block diagram of the components of an emitter for optical traffic preemption system for an embodiment in accordance with the present invention. An optical source 302, such as a Xenon flash tube or high intensity light emitting diode, on a vehicle emits short pulses of light that are received by a detector of a traffic light controller to request preemption of the normal operation of the traffic light to expedite passage of the vehicle through the traffic light.

A signal generation circuit 304 generates an output signal to control the flashes of light from optical source 302. The signal generation circuit 304 can include a transformer used to generate an output signal having high-voltage pulses that each trigger a Xenon strobe light to emit a pulse of light. Data specifying the timing of the pulses of the output signal can be provided by protocol circuit 306, with the pulses of the output signal corresponding to one or more optical communication protocols, which each can have a corresponding traffic light controller implementing a detection protocol. When the pulses of the output signal correspond to more than one optical communication protocol, the pulses can concurrently communicate all of the optical communication protocols.

Protocol circuit 306 can generate the timing specification for the pulses of light emitted by optical source 302. Protocol circuit 306 can generate the timing specification of the pulses of light emitted by optical source 302 by generating the data values to be embedded in the optical pulse stream and encoding these data values to generate the timing specification for the pulses. The data values embedded in the optical pulse stream can include information specified at user interface 308.

In one embodiment, interface 308 includes an input device used by an operator or administrator of the vehicle carrying emitter 300 to specify one or more vehicle identification codes. Example input devices include thumbwheel switches and keyboards. An operator setting up a vehicle identification code can additionally specify an operating mode for the emitter 300. For example, one digit of a multi-digit vehicle identification code can specify that emitter 300 should emit an optical pulse stream compatible with a subset of all the optical communication protocols supported by the emitter. For ease of usage by an operator, the operator can be unaware that a portion of each vehicle identification code actually selects an operating mode instead of or in addition to being embedded in the transmitted optical pulse stream. In another embodiment, interface 308 includes a mechanism to specify default operation of the emitter or to configure operation of the emitter after manufacture, such as jumper settings within the enclosure of the emitter or externally configurable non-volatile storage.

Protocol circuit 306 can generate a specification of the optical pulse stream, including embedding a vehicle identification code received from user interface 308. Protocol circuit 306 can include storage circuits 310 providing protocol information for various optical communication protocols. In one embodiment, each optical communication protocol has a corresponding storage circuit 310. In another embodiment, a single storage circuit 310 provides protocol information for all of the optical communication protocols.

In one embodiment, the information in a storage circuit 310 can be a protocol algorithm, such as protocol state transition diagrams or processor-executable code. The protocol circuit 306 can include a processor, such as a microprocessor, that executes the processor-executable code to create data, such as a specification of the optical pulse stream according to the communication protocols.

In another embodiment, the information in storage circuit 310 can be a logic implementation, such as a programmable logic array or programmable logic device configured with programming data for the communication protocols. In yet another embodiment, the information in storage circuit 310 can be protocol tables, such as the next state and outputs as a function of the current state and inputs. Combinations of a protocol algorithm, a logic implementation, and tables can be used by protocol circuit 306 in alternative embodiments. The contents of storage circuit 310 can be externally accessible to allow the manufacturer or an administrator of a fleet of vehicles to update the communication protocols supported by protocol circuit 306.

What is claimed is:

1. For use in a traffic light control system, an arrangement for requesting preemption from a vehicle, comprising:

a protocol circuit adapted to provide a plurality of communication protocols, wherein a plurality of the communication protocols communicate encoded data;

a signal control generation circuit adapted to generate an output signal in accordance with at least one of the plurality of communication protocols; and an optical source adapted to transmit light pulses from the vehicle, wherein the light pulses are generated from the output signal and include the encoded data for said at least one of the plurality of communication protocols.

2. The arrangement of claim 1, wherein the protocol circuit is adapted to provide the communication protocols using at least one protocol algorithm.

3. The arrangement of claim 1, wherein the protocol circuit is adapted to provide the communication protocols using at least one look-up table that includes patterns representative of at least one of the plurality of communication protocols.

4. The arrangement of claim 3, wherein the protocol circuit has one of said at least one look-up table for each of the communication protocols.

5. The arrangement of claim 3, wherein said at least one look-up table is a table including protocol information for the plurality of communication protocols.

6. The arrangement of claim 1, wherein the protocol circuit is adapted to provide the communication protocols using at least one programmable logic array.

7. The arrangement of claim 6, wherein the protocol circuit has one of said at least one programmable logic array for each of the communication protocols.

8. The arrangement of claim 6, wherein said at least one programmable logic array is a programmable logic array including protocol information for the communication protocols.

9. The arrangement of claim 1, where the protocol circuit is adapted to provide the communication protocols using a protocol algorithm and at least one look-up table including patterns representative of at least one of the communication protocols.

10. The arrangement of claim 1, wherein the signal control generation circuit is adapted to concurrently generate an output signal in accordance with at least two of the plurality of communication protocols.

11. The arrangement of claim 1, further comprising a user interface adapted to select said at least one of the communication protocols.

12. The arrangement of claim 1, further comprising a post-manufacture interface adapted to select said at least one of the communication protocols.

13. The arrangement of claim 1, further comprising a user interface adapted to select a vehicle identification code included in the encoded data for said at least one of the plurality of communication protocols.

14. The arrangement of claim 13, wherein said at least one of the communication protocols is set as a function of the vehicle identification code.

15. The arrangement of claim 14, wherein said at least one of the communication protocols is selected as a function of the vehicle identification code being assigned.

16. The arrangement of claim 1, wherein the protocol circuit is adapted to store processor-executable code that is executed to create the encoded data according to said at least one of the plurality of communication protocols.

17. The arrangement of claim 1, wherein the protocol circuit includes a microprocessor circuit and is adapted to store processor-executable code that is executed to create the encoded data according to said at least one of the plurality of communication protocols.

18. The arrangement of claim 1, wherein the encoded data for said at least one of the plurality of communication protocols is encrypted using an encryption key.

19. For use in a traffic light control system, an arrangement for requesting preemption, comprising:

a vehicle mounting arrangement;

means for providing a plurality of communication protocols, wherein a plurality of the communication protocols communicate encoded data;

means, supported by the vehicle mounting arrangement, for generating an output signal in accordance with at least one of the plurality of communication protocols; and means for transmitting light pulses, wherein the light pulses are generated from the output signal and include the encoded data for said at least one of the plurality of communication protocols.

20. For use in a device adapted to communicate with a traffic light control system, a method for requesting preemption at a traffic light controller, the method comprising:

providing a plurality of communication protocols, wherein a plurality of the communication protocols communicate encoded data;

generating an output signal in accordance with at least one of the plurality of communication protocols; and transmitting light pulses, wherein the light pulses are generated from the output signal and include the encoded data for said at least one of the plurality of communication protocols.

* * * * *